US007062959B2

(12) United States Patent
Kurkjian et al.

(10) Patent No.: US 7,062,959 B2
(45) Date of Patent: Jun. 20, 2006

(54) METHOD AND APPARATUS FOR DETERMINING DOWNHOLE PRESSURES DURING A DRILLING OPERATION

(75) Inventors: Andrew L. Kurkjian, Sugar Land, TX (US); Jean-Marc Follini, Houston, TX (US); Patrick J. Fisseler, Missouri City, TX (US); Thomas W. Palmer, II, Stafford, TX (US); Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/248,124

(22) Filed: Dec. 19, 2002

(65) Prior Publication Data

US 2004/0025583 A1 Feb. 12, 2004

Related U.S. Application Data

(63) Continuation-in-part of application No. 10/064,774, filed on Aug. 15, 2002, now Pat. No. 6,843,117.

(51) Int. Cl.
*E21B 44/00* (2006.01)
*E21B 47/12* (2006.01)

(52) U.S. Cl. ..... 73/152.46; 73/152.03

(58) Field of Classification Search ..... 73/152.03, 73/152.43, 152.46
See application file for complete search history.

(56) References Cited

U.S. PATENT DOCUMENTS 3,011,554 A * 12/1961 Desbrandes et al. ..... 166/100
3,934,468 A 1/1976 Brieger
4,278,130 A * 7/1981 Evans et al. ..... 166/66
4,339,948 A * 7/1982 Hallmark ..... 73/152.26
4,833,914 A 5/1989 Rasmus
4,860,581 A 8/1989 Zimmerman
4,893,505 A 1/1990 Marsden et al.
4,936,139 A 6/1990 Zimmerman et al.
5,233,866 A 8/1993 Desbrandes
5,242,020 A 9/1993 Cobern
5,339,036 A 8/1994 Clark et al.
5,602,334 A * 2/1997 Proett et al. ..... 73/152.05
5,622,223 A 4/1997 Vasquez
5,703,286 A * 12/1997 Proett et al. ..... 73/152.05
5,789,669 A 8/1998 Flaum (Continued)

OTHER PUBLICATIONS

CD Ward & E Andreassen, "Performance while Drilling Data Improves Reservoir Drilling Performance," *SPE/IADC 37588*, pp. 159-168, SPE/IADC Drilling Conf., Amsterdam NL (Mar. 4-6, 1997).

(Continued)

*Primary Examiner*—Hezron Williams
*Assistant Examiner*—John Fitzgerald
(74) *Attorney, Agent, or Firm*—J. L. Jennie Salazar; Victor H. Segura; Brigitte L. Echols

(57) ABSTRACT

A method and apparatus is provided to determine downhole pressures, such as annular pressure and/or pore pressure, during a drilling operation. A downhole drilling tool includes at least one conduit and a corresponding gauge. The conduit is positioned in the downhole tool and has an opening adapted to receive downhole fluids. The conduit is positionable in fluid communication with one of the wellbore and the formation whereby pressure is equalized therebetween. The gauge is provided for measuring the pressure in the conduit.

56 Claims, 8 Drawing Sheets

U.S. PATENT DOCUMENTS

| | | | | |
|---|---|---|---|---|
| 5,803,186 | A | 9/1998 | Berger et al. | |
| 6,026,915 | A | 2/2000 | Smith et al. | |
| 6,047,239 | A | 4/2000 | Berger et al. | |
| 6,068,394 | A | 5/2000 | Dublin, Jr. | |
| 6,230,557 | B1 | 5/2001 | Ciglenec et al. | |
| 6,263,726 | B1 | 7/2001 | Hubbell et al. | |
| 6,269,891 | B1 | 8/2001 | Runia | |
| 6,343,650 | B1 * | 2/2002 | Ringgenberg | 166/250.17 |
| 6,581,455 | B1 | 6/2003 | Berger et al. | |

OTHER PUBLICATIONS

GR Samuel et al., "Field Validation of Transient Swab/Surge Response with PWD Data," *SPE/IADC 67717*, pp. 1-5, SPE/IADC Drilling Conf., Amsterdam NL (Feb. 27-Mar. 1, 2001).

* cited by examiner

FIG.9A
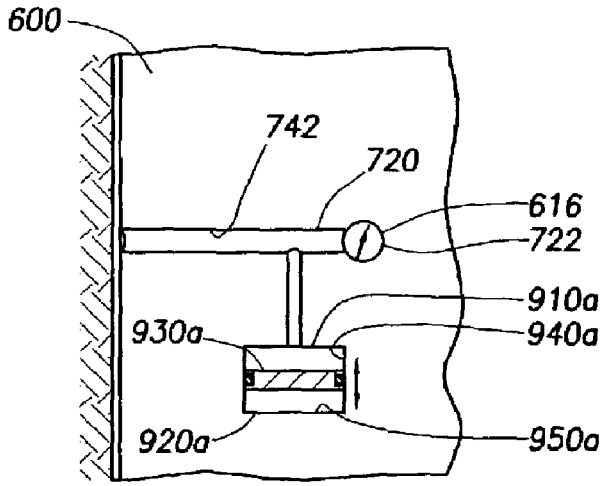
FIG.9B
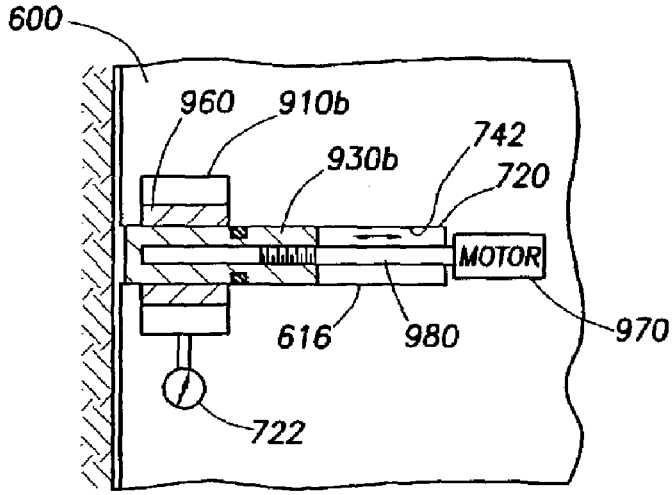
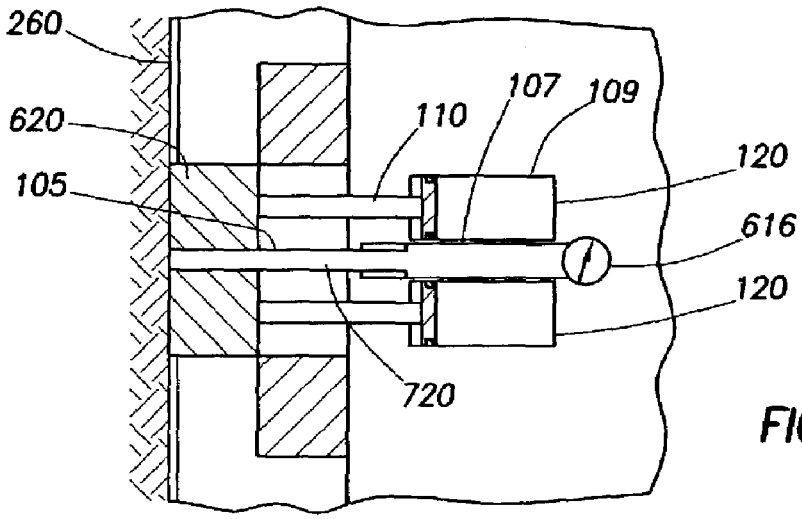
FIG.10

METHOD AND APPARATUS FOR DETERMINING DOWNHOLE PRESSURES DURING A DRILLING OPERATION

CROSS REFERENCE TO RELATED APPLICATIONS

This application is a continuation in part of U.S. patent application Ser. No. 10/064,774 filed on Aug. 15, 2002 and assigned to the assignee of the present invention.

BACKGROUND OF INVENTION

This invention relates generally to the determination of various downhole parameters of a wellbore penetrated by a subsurface formation. More particularly, this invention relates to the determination of downhole pressures, such as annular pressure and/or formation pore pressure, during a wellbore drilling operation. In a typical drilling operation, a downhole drilling tool drills a borehole, or wellbore, into a rock or earth formation. During the drilling process, it is often desirable to determine various downhole parameters in order to conduct the drilling process and/or learn about the formation of interest.

Present day oil well operation and production involves continuous monitoring of various subsurface formation parameters. One aspect of standard formation evaluation is concerned with the parameters of downhole pressures and the permeability of the reservoir rock formation. Monitoring of parameters, such as pore pressure and permeability, indicate changes to downhole pressures over a period of time, and is essential to predict the production capacity and lifetime of a subsurface formation, and to allow safer and more efficient drilling conditions. Such downhole pressures may include annular pressure ($P_A$ or wellbore pressure), pressure of the fluid in the surrounding formation ($P_P$ pore pressure), as well as other pressures.

During drilling of oil and gas wells using traditional downhole tools, it is common for the drill string to become stuck against the formation. A common type of sticking, known as differential sticking, occurs when a seal is formed between a portion of the downhole tool and the mudcake lining the formation. The pressure of the wellbore relative to the formation pressure assists in maintaining the seal between the mud cake and the downhole tool, typically when the tool is stationary. The hydrostatic pressure acting on the downhole tool increases the friction and makes movement of the drill pipe difficult or impossible. Monitoring downhole pressure conditions enables detection of the downhole pressure conditions likely to result in differential sticking.

Techniques have been developed to obtain downhole pressure measurements through wireline logging via a "formation tester" tool. This type of measurement requires a supplemental "trip" downhole with another tool, such as a formation tester tool, to take measurements. Typically, the drill string is removed from the wellbore and a formation tester is run into the wellbore to acquire the formation data. After retrieving the formation tester, the drill string must then be put back into the wellbore for further drilling. Examples of formation testing tools are described in U.S. Pat. Nos. 3,934,468; 4,860,581; 4,893,505; 4,936,139; and 5,622,223. These patents disclose techniques for acquiring formation data while the wireline tools are disposed in the wellbore, and in physical contact with the formation zone of interest. Since "tripping the well" to use such formation testers consumes significant amounts of expensive rig time, it is typically done under circumstances where the formation data is absolutely needed, or it is done when tripping of the drill string is done for a drill bit change or for other reasons.

Techniques have also been developed to acquire formation data from a subsurface zone of interest while the downhole drilling tool is present within the wellbore, and without having to trip the well to run formation testers downhole to identify these parameters. Examples of techniques involving measurement of various downhole parameters during drilling are set forth in U.K. Patent Application GB 2,333,308 assigned to Baker Hughes Incorporated, U.S. patent application Ser. No. 6,026,915 assigned to Halliburton Energy Services, Inc. and U.S. Pat. No. 6,230,557 assigned to the assignee of the present invention.

Despite the advances in obtaining downhole formation parameters, there remains a need to further develop techniques which permit data collection during the drilling process. Benefits may also be achieved by utilizing the wellbore environment and the existing operation of the drilling tool to facilitate measurements. FIG. 1 shows a typical drilling system and related environment. A downhole drilling tool 100 is extended from a rig 180 into a wellbore 110 and drilling fluid 120, commonly known as "drilling mud", is pumped into an annular space 130 between the drilling tool and the wellbore. The drilling mud performs various functions to facilitate the drilling process, such as lubricating the drill bit 170 and transporting cuttings generated by the drill bit during drilling. The cuttings and/or other solids mix within the drilling fluid to create a "mudcake" 160 that also performs various functions, such as coating the borehole wall. Portions of the drilling tool often scrape against the wellbore wall, push away the mudcake and come into direct contact with the wellbore wall. When the drill string stops periodically, as it does when a standoff pipe is added, portions of the drilling tool may also rest against the wellbore wall, and mudcake if present.

The dense drilling fluid 120 conveyed by a pump 140 is used to maintain the drilling mud in the wellbore at a pressure (annular pressure $P_A$) higher than the pressure of fluid in the surrounding formation 150 (pore pressure $P_P$) to prevent formation fluid from passing from surrounding formations into the borehole. In other words, the annular pressure ($P_A$) is maintained at a higher pressure than the pore pressure ($P_P$) so that the wellbore is "overbalanced"($P_A > P_P$) and does not cause a blowout. The annular pressure ($P_A$) must also, however, be maintained below a given level to prevent the formation surrounding the wellbore from cracking, and to prevent drilling fluid from entering the surrounding formation. Thus, downhole pressures are typically maintained within a given range.

The downhole drilling operation, known pressure conditions and the equipment itself may be manipulated to facilitate downhole measurements. It is desirable that techniques be provided to take advantage of the drilling environment to facilitate downhole measurements of parameters such as annular pressure and/or pore pressure. It is further desirable that such techniques be capable of providing one or more of the following, among others, adaptability to various wellbore and/or equipment conditions, measurements close to the drill bit, improved accuracy, simplified equipment, detection of sticking risks, real time data, and/or measurements during the drilling process. Added benefit would be achieved where analysis of wellbore operations could be conducted even in cases where accuracy of measurements and/or readings are poor.

SUMMARY OF INVENTION

In at least one aspect, the present invention relates to an apparatus for measuring downhole pressure. The apparatus is disposed in a downhole drilling tool positionable in a wellbore having an annular pressure therein. The wellbore penetrates a subterranean formation having a pore pressure therein. The apparatus comprises a conduit and a gauge. The conduit positioned in the downhole tool and having an opening adapted to receive downhole fluids. The conduit positionable in fluid communication with one of the wellbore and the formation whereby pressure is equalized therebetween. The gauge measures pressure in the conduit.

In yet another aspect, the present invention relates to a downhole drilling tool capable of measuring downhole pressures during a drilling operation. The downhole drilling tool is positionable in a wellbore having an annular pressure therein. The wellbore penetrates a subterranean formation having a pore pressure therein. The tool comprises a bit, a drill string, at least one drill collar connected to the drill string, and a gauge. The drill collar has a cavity therein. The drill collar is positionable adjacent the sidewall of the wellbore with the cavity in fluid communication with one of the formation and the wellbore whereby pressure is equalized therebetween. The gauge measures pressure of the fluid in the cavity whereby one of the pore and the formation pressure is determined.

In another aspect, the present invention relates to a method of measuring downhole pressures during a drilling operation in a wellbore having an annular pressure therein. The wellbore penetrates a formation having a pore pressure therein. The method comprises positioning a downhole drilling tool in a wellbore, positioning the conduit in fluid communication with one of the formation and the wellbore such that pressure is equalized therebetween and measuring the pressure in the conduit. The downhole drilling tool comprises a conduit and a gauge, the conduit having an opening adapted to receive downhole fluids, the gauge operatively connected to the conduit.

In yet another aspect, the present invention relates to an apparatus for measuring downhole pressure. The apparatus comprises a first conduit, a second conduit and at least one gauge. The first conduit is positionable in a protruding portion of the drilling tool. The protruding portion is positionable adjacent a sidewall of the wellbore such that fluid communication is established between the conduit and one of the formation and the wellbore whereby pressure equalization occurs therebetween. The second conduit is positionable in a non-protruding portion of the drilling tool. The non-protruding portion is positionable in non-engagement with the sidewall of the wellbore such that fluid communication is established between the conduit and one of the formation and the wellbore whereby pressure equalization occurs therebetween. The at least one gauge measures the pressure in the conduits.

Finally, in yet another aspect, the present invention relates to an apparatus for determining downhole pressures. The apparatus is positionable in a downhole tool disposable in a wellbore. The apparatus comprises a drill collar having a cavity therein and a gauge. The cavity is adapted to receive downhole fluid. The downhole tool has an outer surface positionable in one of engagement and non-engagement with the wellbore wall. The conduit has an opening extending through the outer surface. The gauge is operatively connected to the cavity for measuring pressure therein.

The apparatus may further be provided with a second conduit and an equalizing mechanism operatively connected thereto. The second conduit is in fluid communication with the wellbore. The pressure equalizing mechanism may be a control valve capable of equalizing an internal pressure of the apparatus with one of the annular pressure and the pore pressure. The pressure equalizing mechanism is capable of selectively connecting the first and second conduit whereby an internal pressure in the first fluid conduit is equalized to one of the annular pressure and the pore pressure. The apparatus may then be disposed in a downhole drilling tool and lowered into a wellbore. The pressure in the apparatus is equalized with one of the annular pressure of the wellbore and the pore pressure of the subterranean formation, and the internal pressure is measured.

There has thus been outlined, rather broadly, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

BRIEF DESCRIPTION OF DRAWINGS

FIG. 9 is a partial, longitudinal cross sectional view of a pressure measuring assembly including a pretest piston.

FIG. 10 is a partial, longitudinal cross sectional view of a pressure measuring assembly extendable from a downhole tool.

DETAILED DESCRIPTION

Figure 1:
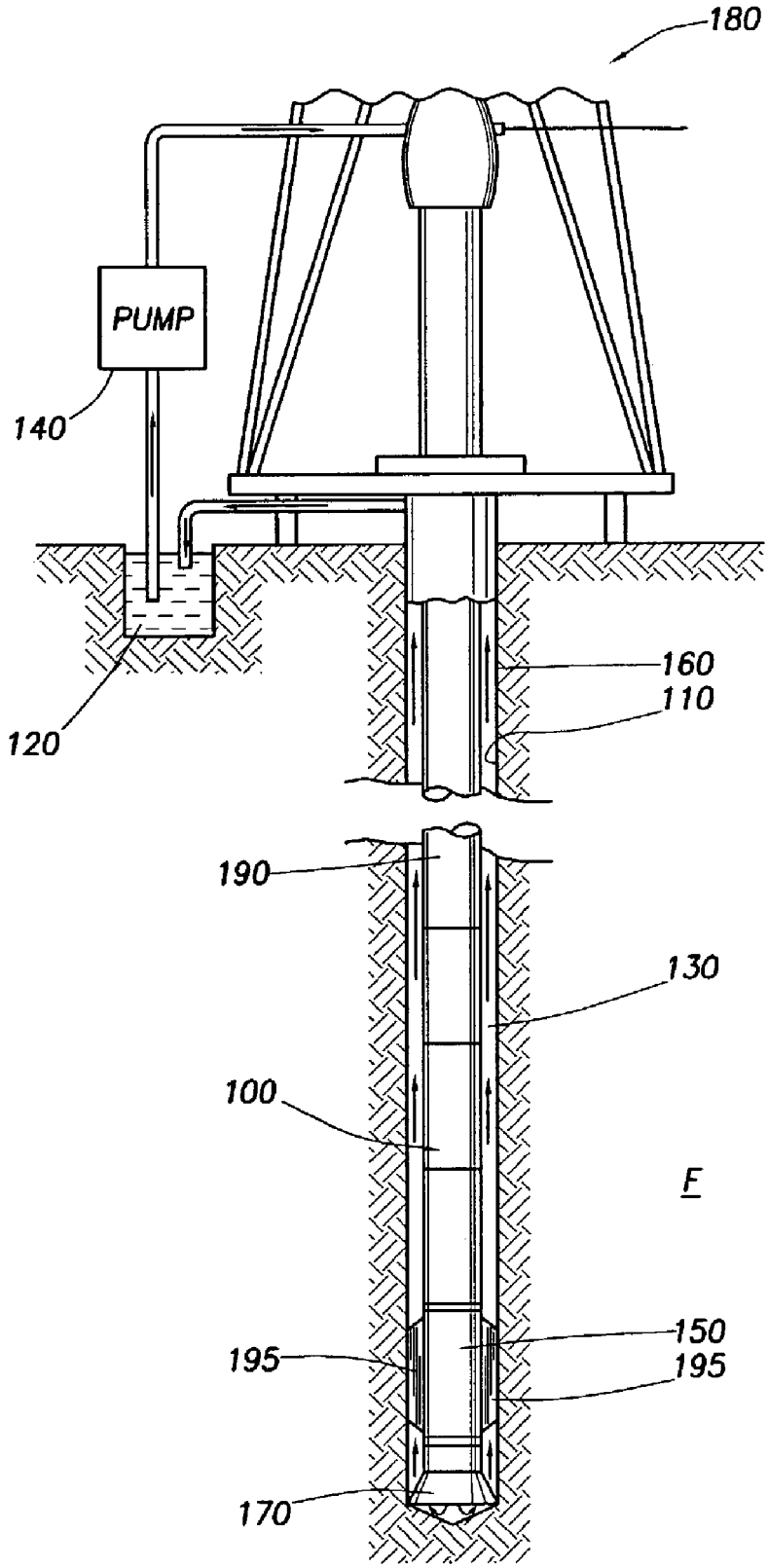
FIG. 1 is an elevational view, partially in section and partially in block diagram, of a conventional drilling rig and drill string employing the present invention.

FIG. 1 illustrates a conventional drilling rig and drill string in which the present invention can be utilized to advantage. Land-based rig 180 is positioned over wellbore 110 penetrating subsurface formation F. The wellbore 110 is formed by rotary drilling in a manner that is well known. Those of ordinary skill in the art given the benefit of this disclosure will appreciate, however, that the present invention also finds application in other drilling applications, such as directional drilling and rotary drilling, and is not limited to land-based rigs.

Drill string 190 is suspended within wellbore 110 and includes drill bit 170 at its lower end. Drilling fluid or mud 120 is pumped by pump 140 to the interior of drill string 190, inducing the drilling fluid to flow downwardly through drill string 190. The drilling fluid exits drill string 190 via ports in drill bit 170, and then circulates upwardly through the annular space 130 between the outside of the drill string and the wall of the wellbore as indicated by the arrows. In this manner, the drilling fluid lubricates drill bit 170 and carries formation cuttings up to the surface as it is returned to the surface for recirculation.

Drill string 190 further includes a bottom hole assembly (BHA), generally referred to as 150. The bottom hole assembly may include various modules or devices with capabilities, such as measuring, processing, storing information, and communicating with the surface, as more fully described in U.S. Pat. No. 6,230,557 assigned to the assignee of the present invention, the entire contents of which are incorporated herein by reference.

As shown in FIG. 1, bottom hole assembly 150 is provided with stabilizer blades 195 extending radially therefrom. One or more stabilizing blades, typically positioned radially about the drill string, are utilized to address the tendency of the drill string to "wobble" and become decentralized as it rotates within the wellbore, resulting in deviations in the direction of the wellbore from the intended path (such as a straight vertical line, curved wellbore or combinations thereof). Such deviation can cause excessive lateral forces on the drill string sections as well as the drill bit, producing accelerated wear. This action can be overcome by providing a means for centralizing the drill bit and, to some extent, the drill string, within the wellbore. Examples of centralizing tools that are known in the art include pipe protectors, wear bands and other tools, in addition to stabilizers.

Figure 2:
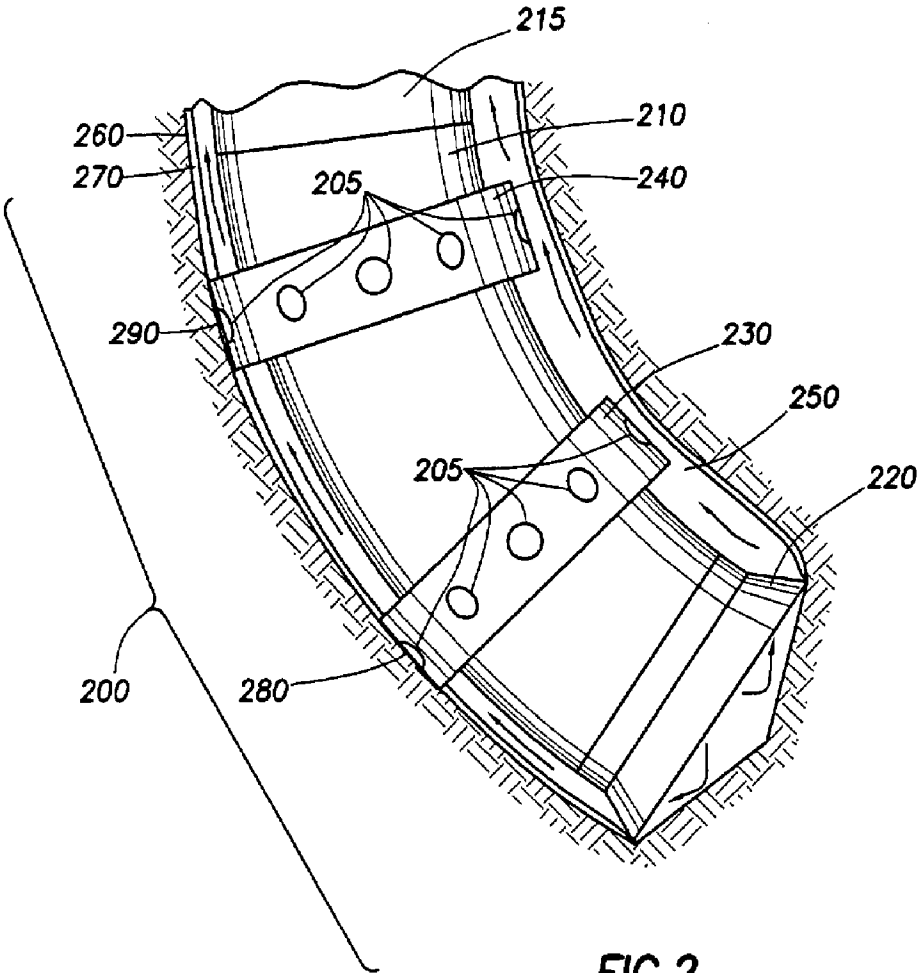
FIG. 2 is an elevational view, partially in cross-section, of a bottom hole assembly (BHA) forming part of a drilling system and having pressure equalizing assemblies.

FIGS. 2–5 relate to various aspects of an apparatus incorporating a pressure equalization mechanism. FIG. 2 depicts a portion of a downhole drilling tool disposed in a wellbore, such as the downhole drilling tool of FIG. 1, having a bottom hole assembly (BHA) 200. The BHA 200, as shown in FIG. 2, includes a drill collar 210 made of metal tubing, a drill bit 220, stabilizer blade 230, wear band 240 and pressure equalizing assemblies 205.

The BHA 200 of FIG. 2 is adapted for axial connection with a drill string 215. Drill collar 210 of FIG. 2 may be equipped with pin and box ends (not shown) for conventional make-up within the drill string. Such ends may be customized collars that are connected to the central elongated portion of drill collar 210 in a conventional manner, such as threaded engagement and/or welding.

Drilling fluid, or drilling mud, flows down the center of the cylindrically-shaped drill collar 210 of the BHA 200, out ports (not shown) in the drill bit 220, up an annular space 250 between the drill collar 210 and the borehole 260, and back up to the surface as indicated by the arrows. The drilling fluid mixes with cuttings from the drill bit 220 under annular pressure ($P_A$) in the wellbore, and forms a mud cake 270 along the walls of the wellbore 260.

As shown in FIG. 2, the BHA 200 is provided with a stabilizer blade 230 positioned about drill collar 210. It will, however, be appreciated that a variety of one or more stabilizers may disposed about the drill collar 210, such as the linear stabilizer blades 195 disposed radially about bottom hole assembly 150 of FIG. 1. Other configurations of stabilizers, if present, may be envisioned with various components to enhance the movement and/or stability of the drill collar within the wellbore as described in U.S. Pat. No. 6,230,557, previously incorporated herein.

With continuing reference to FIG. 2, the BHA 200 is also preferably provided with at least one wear band 240 adapted to protect the BHA from damage in the wellbore. As shown in FIG. 2, the wear band 240 is generally circular and extends radially about the drill collar. While FIG. 2 depicts a single, circular wear band extending a given distance radially about the drill collar, it will be appreciated by one of skill in the art that other configurations of one or more wear bands, if present, may be disposed about various portions of the drill collar to provide protection thereto.

The drill bit 220, the stabilizer blade 230 and the wear band 240 are depicted in FIG. 2 as extending a distance radially beyond the drill collar 210, and contacting portions of the borehole. For example, stabilizer blade 230 contacts the borehole at contact surface 280 and wear band 240 contacts the borehole at contact surface 290. As shown in FIG. 2, portions of the BHA 200 contact the wellbore and scrape away mudcake 270 such that the contact surfaces come in direct contact with the wellbore wall 260.

While contact surfaces 280 and 290 are depicted as being in contact with portions of the wellbore, high vibration, movement in the wellbore, variation in the drilling path and other factors may cause various portions of the BHA 200 to come in contact with the wellbore. Gravitational pull typically causes the contact surfaces on the bottom side of the BHA to contact the lowest points along the wellbore. Additionally, the portions of the BHA extending the furthest from the drill collar typically contact the wellbore. However, other points of contact may occur along other surfaces of the drill collar under various wellbore conditions and with various tool configurations.

Figure 3B:
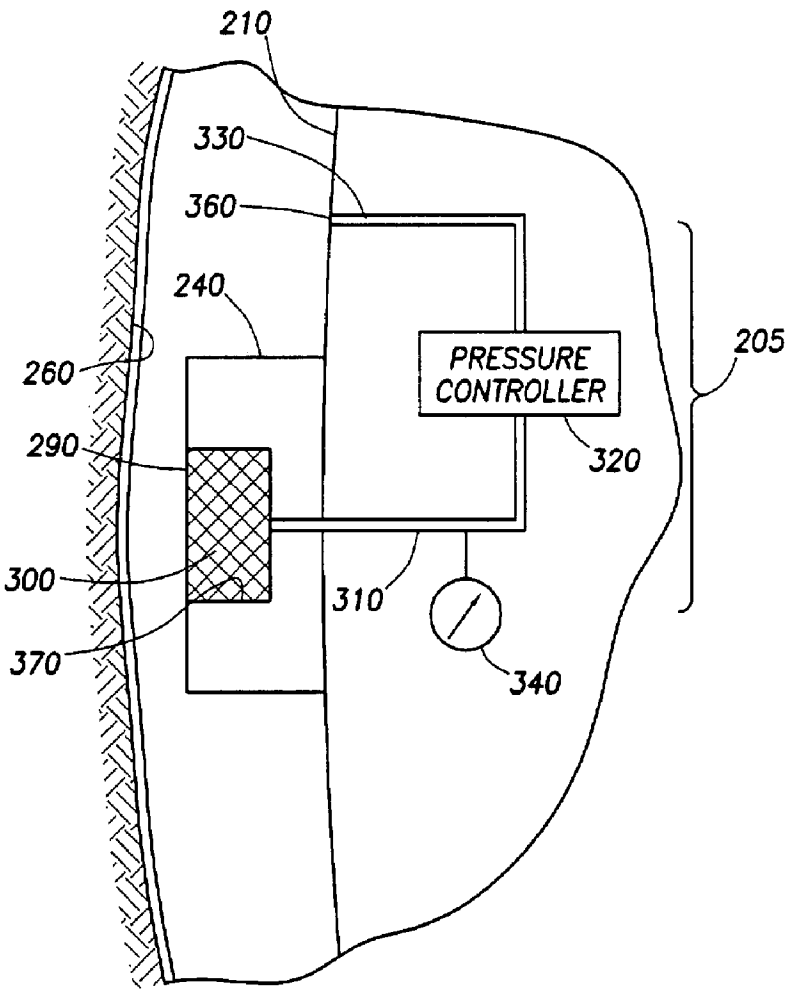
FIGS. 3A and 3B are cross-sectional views, partially in block diagram, of a pressure equalizing assembly of FIG. 2 in greater detail.
Figure 3A:
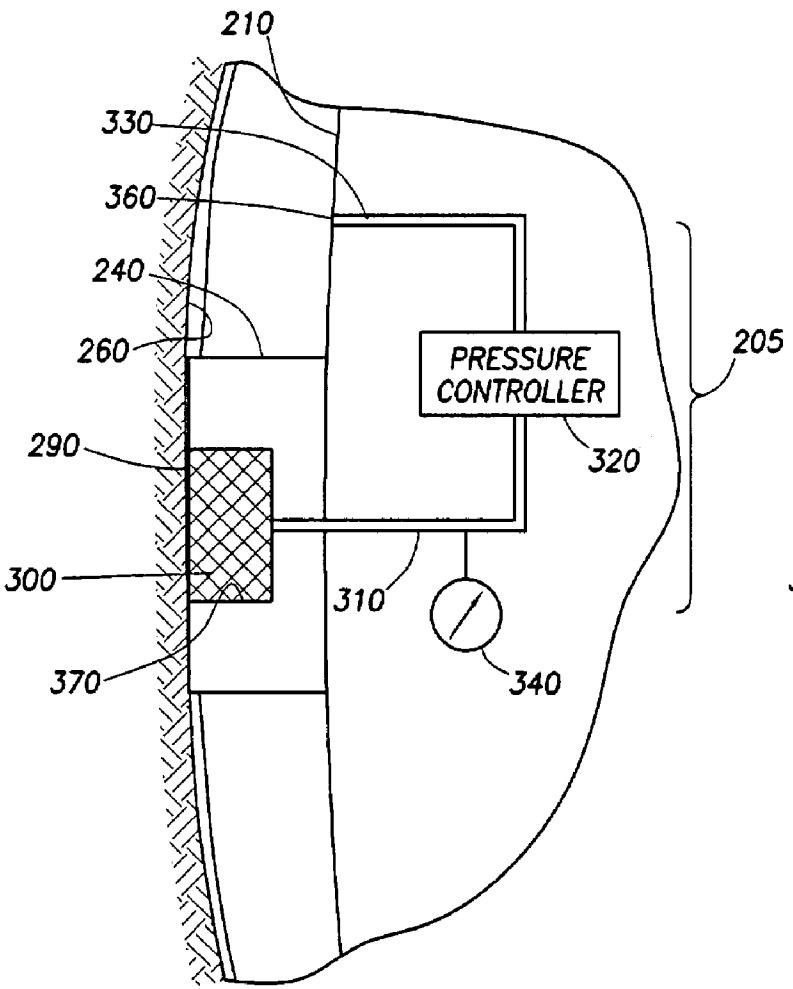

Referring now to FIGS. 3A and 3B, a pressure equalizing assembly positioned in wear ring 240 the BHA of FIG. 2 is depicted in greater detail. FIG. 3A shows the pressure equalizing assembly 205 having a contact surface 290 in engagement with the wellbore 260. FIG. 3B shows the pressure equalizing assembly 205 having a contact surface 290 in non-engagement with the wellbore 260. The preferred embodiment of pressure equalizing assembly 205 includes a filter 300, a first conduit 310, a pressure gauge 340, a pressure controller 320 and a second conduit 330. An opening 370 extends through the contact surface 290 and allows filtered fluids to flow therethrough. An opening 360 extends through a portion of the drill collar 210 and allows fluid to flow therethrough.

Filter 300 is adapted to allow fluids to pass through opening 370 while preventing solids or drilling muds from entering the BHA 200. The filter 300 may be any filter capable of preventing drilling fluids, drilling muds and/or solids from passing into conduit 310 without clogging. An example of a porous solid, such as a sintered metal, usable as a filter may be obtained from GKN Sinter Metals of Richton Park, Ill., available at www.gkn-filters.com. The porous solid may be a porous ceramic.

The first conduit 310 extends from the filter 300 to pressure controller 320, and provides a fluid pathway or chamber between opening 370 and pressure equalizing assembly 205. The second conduit 330 extends from the pressure controller 320 to opening 370, and provides a fluid pathway or chamber from the pressure equalizing assembly 205 to the wellbore.

As shown in FIGS. 3A and 3B, the drill collar 210 is depicted as being in non-engagement with the wellbore 260. In this position, fluid from the wellbore is in fluid communication with second conduit 330. In FIG. 3A, the wear band 240 is in direct contact with the wellbore 260 such that the contact surface 290 is flush thereto, and the first conduit 310 is in fluid communication with the formation. In contrast, as shown in FIG. 3B, the wear band 240 is in non-engagement with the wellbore 260, and fluid in first conduit 310 is no longer in fluid communication with the formation. Because filter 370 prevents drilling muds from entering conduit 310, the first conduit 310 is typically prevented from establishing fluid communication with the wellbore or the mud cake.

The pressure equalizing assembly 205 preferably further includes a pressure gauge 340 to measure the pressure of the drilling fluids in conduit 310. The pressure gauge may be provided with associated measurement electronics, known as an annular pressure while drilling (APWD) system. The pressure gauge 340 may be used to monitor conditions uphole, provide information for the actuator, check valve or other operational devices and/or to make uphole or downhole decisions using either manual or automatic controls.

Figure 4B:
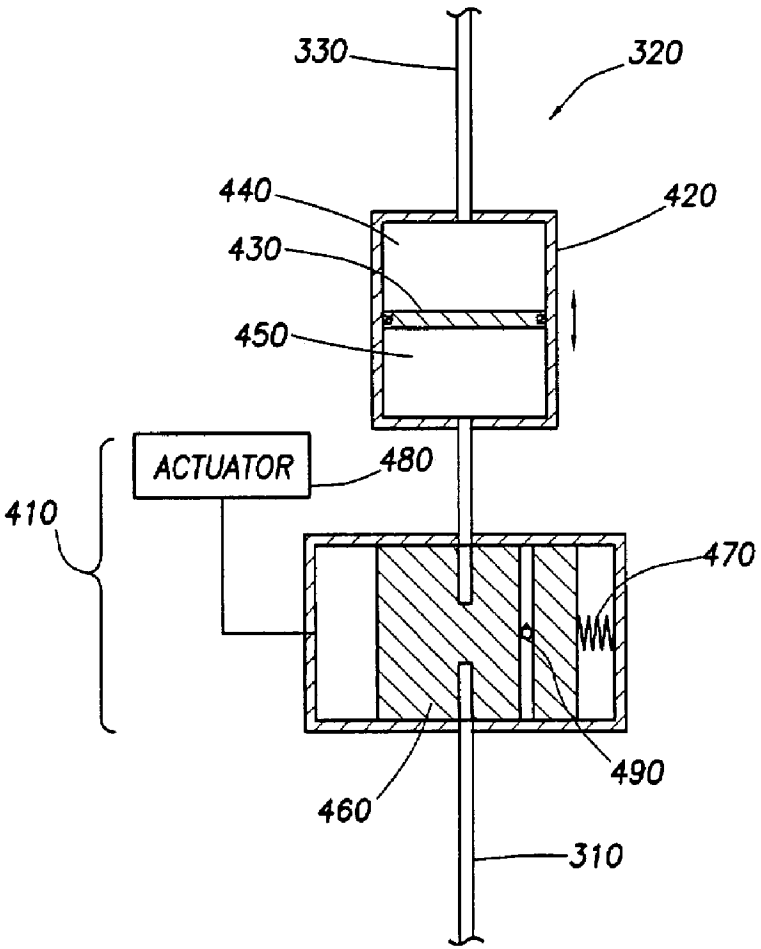
FIGS. 4A and 4B are cross-sectional views, partially in block diagram, of a pressure assembly forming part of the pressure equalizing assembly of FIGS. 3A and 3B.
Figure 4A:
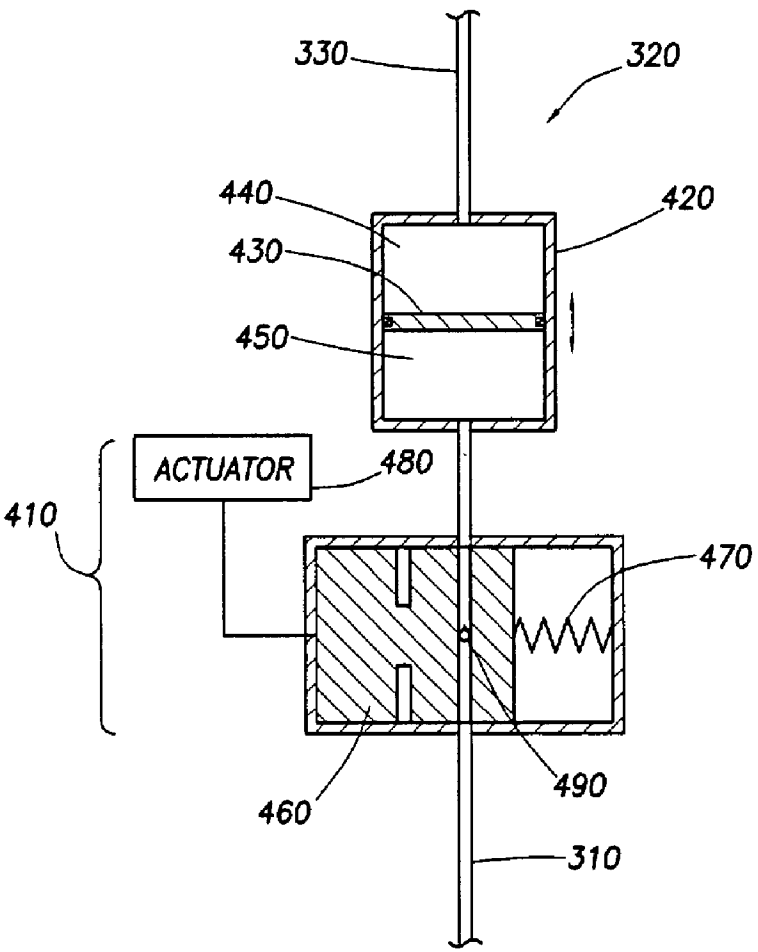

Referring now to FIGS. 4A and 4B, the pressure controller 320 of FIGS. 3A and 3B is shown in greater detail. The pressure controller 320 includes a pressure cylinder 420 and a valve assembly 410. FIG. 4A depicts the valve assembly 410 in the open position, while FIG. 4B depicts the valve assembly 410 in the closed position.

The cylinder 420 of the pressure controller includes a movable fluid separator, such as a piston 430, defining a variable volume drilling fluid chamber 440 and a variable volume buffer fluid chamber 450. The piston 430 moves within the cylinder 420 in response to pressure such that pressure is equalized between the fluid chamber 440 and the buffer chamber 450.

The fluid chamber 440 is in fluid communication with conduit 330. Fluid in chamber 440, therefore, typically contains wellbore fluids flowing into conduit 330 through opening 360 as previously described with respect to FIGS. 3A and 3B. In contrast, buffer chamber 450 of FIGS. 4A and 4B is provided with a buffer fluid used to respond to the fluid pressure in the piston and advance through the pressure equalizing assembly. Preferably, low viscosity hydraulic fluid, such as Exxon Mobil Univis J26, Texaco Hydraulic Oil 5606G, etc., or other fluids, such as nitrogen gas, water, etc. may be utilized. The buffer chamber 450 is in selective fluid communication with conduit 310 via valve assembly 410.

Referring still to FIGS. 4A and 4B, valve assembly 410 preferably includes a sliding valve 460, a spring 470, an actuator 480 and an internal check valve 490. The sliding valve 460 is movable between an open position as depicted in FIG. 4A, and a closed position as depicted in FIG. 4B, to selectively allow pressure equalization between buffer chamber 450 and conduit 310.

The spring 470 of valve assembly 410 is preferably provided to apply a force to maintain the sliding valve in the open position. However, an actuator is preferably provided to selectively move the valve between the open and closed position as will be described further with respect to FIG. 4B. When the activator is not acting upon the valve, the spring will maintain the valve in the open position as depicted in FIG. 4A.

In the open position of FIG. 4A, the sliding valve 460 operatively connects buffer chamber 450 with conduit 310. In other words, sliding valve 460 provides fluid communication between buffer chamber and conduit 310. In this position, pressure equalization may be established between buffer chamber 450 and conduit 310.

Because pressure equalization is already established between buffer chamber 450 and fluid chamber 440, pressure equalization may also be established between conduit 310 and fluid chamber 440 via buffer chamber 450. Thus, in the open position, pressure in conduit 310 equalizes to the same pressure as fluid in the buffer chamber 450, the fluid chamber 440 and the wellbore. Because the pressure in buffer chamber 450 is typically the annular pressure ($A_P$), the pressure gauge 340 (FIG. 3) registers this annular pressure.

Referring back to FIG. 4A, as wellbore fluid enters fluid chamber 440, piston 430 moves within cylinder 420 in response to a change in pressure. The piston adjusts the volume of fluid chamber 440 with respect to buffer chamber 450 until pressure equalizes. Where pressure is higher in conduit 330 than in conduit 310, the piston moves to expand the fluid chamber and contract the buffer chamber. As the buffer chamber contracts, buffer fluid is forced from buffer chamber 450, through sliding valve 460 and out through conduit 310 until the pressure equalizes. Preferably, a check valve 490 is preferably provided to prevent entry of the fluid from conduit 310 through sliding valve 460 to the buffer chamber 450. The check valve may be either manually or automatically adjusted to control the flow of fluid between the buffer chamber 450 and conduit 310.

Optionally, the valve assembly may be configured such that, where the pressure from conduit 330 and fluid chamber 440 is less than the pressure in buffer chamber 450, piston 430 will move such that the buffer chamber 450 expands and the fluid chamber 440 retracts. Fluid from conduit 330 would then be pushed out of the pressure equalizing mechanism through opening 360 and into the wellbore.

Referring now to FIG. 4B, sliding valve 460 has been shifted from the open position of FIG. 4A to the closed position. The actuator 480 is preferably provided to selectively overcome the force of the spring and move the sliding valve between the open and closed position. The actuator 480 overcomes the force of spring 470 to move the sliding valve 460 to the closed position in response to a signal or command.

Preferably, the actuator is capable of moving the valve to the closed position when the drilling operation has stopped and the BHA is at rest. Other signals or commands may be used to signal the actuator to shift the valve between the open and closed position, such as a pressure reading from gauge 340, operator input or other factors. The actuator may be hydraulically, electrically, manually, automatically or otherwise activated to achieve the desired movement of the valve.

In the closed position of FIG. 4B, the sliding valve prevents fluid communication and/or pressure equalization between the buffer chamber 450 and conduit 310. The pressure of conduit 310 when the valve is in the closed position depends on whether contact surface 370 is adjacent the wellbore as in FIG. 3A, or in non-engagement with the wellbore as in FIG. 3B.

When the valve is in the closed position and contact surface 370 is in engagement with the wellbore as shown in FIG. 3A, fluid communication is established between conduit 310 and the formation. Once fluid communication is established, fluid pressures will equalize between the conduit 310 and the fluid in the formation. The pressure in gauge 340 will then read the pressure of the fluid in the formation, namely the pore pressure ($P_P$).

When the valve is in the closed position and contact surface 370 is in non-engagement with the wellbore as shown in FIG. 3B, conduit 310 is isolated from wellbore pressures by the sliding valve 460 at one end and the filter 300 on another end thereof. The conduit 310, therefore, maintains the annular pressure achieve when the sliding valve was in the open position. Thus, the pressure in gauge 340 will continue to read the annular pressure ($P_A$)

While FIGS. 2–4 depict multiple individual equalizing assemblies, it will be appreciated that one or more pressure equalizing assembly may be provided with its own pressure controller, or multiple pressure equalizing assemblies may be operated by the same pressure controller. 330 may be provided with multiple channels to various openings 370 about the BHA and/or downhole tool. Conduit 310 may be provided with multiple channels to various filters about the BHA and/or downhole tool. Conduits 330 and/or 310 may have channels diverted to various locations about the BHA and/or downhole tool. Valves or other controls or configurations may be envisioned to selectively control fluid flow through the conduits as desired.

In operation, the downhole drilling tool advances to drill the wellbore as shown in FIG. 1. As a BHA or other portion of the drilling tool advances, wellbore fluid is permitted to flow from the wellbore, through opening 360 and into conduit 330 of the pressure equalizing assembly (FIG. 3B). As the drilling tool operates and/or moves through the wellbore, valve assembly 410 remains in the open position (FIG. 4A). In the open position, wellbore fluid is permitted to flow into conduit 330, activate piston 430 and move to equalize pressure in the fluid and buffer chambers. Buffer fluid is in fluid communication with conduit 310 and permits pressure equalization between the buffer chamber and conduit 310. The pressure eventually equalizes to the pressure of the fluid in the wellbore, namely the annular pressure ($P_A$). Pressure gauge 400, therefore, typically registers at the annular pressure ($P_A$) when the drilling process is occurring and/or the sliding valve is maintained in the open position. The pressure equalizing device continues to operate to equalize the annular pressure within the pressure equalizing assembly.

During the drilling process, the BHA of the drilling tool scrapes the sidewall of the wellbore to provide contact between a surface of the BHA and the wellbore. The BHA may come to rest during the drilling process, either due to pauses in the drilling operation or intentional stops for measurements (FIG. 4B). In this position, termination of movement and vibration of the drilling tool signals the actuator to shift the sliding valve to the closed position. The fluid in the conduit 310 is then isolated from the fluid and pressure of the wellbore via the sliding valve at one end and the filter at another end thereof.

If the contact surface of the BHA is in contact with the wellbore wall (FIG. 3A), fluid communication may be established between the formation and conduit 310. Pressure is then equalized between the formation and the conduit 310. Pressure gauge 340, therefore, typically registers the pressure of the fluid in the formation and the conduit, namely the pore pressure ($P_P$). Thus, when contact surface 290 and filter 300 are in contact with the wellbore and the BHA is at rest, the actuator will move to the closed position and pressure will equalize between the first conduit 310 and the fluid formation so that the pressure gauge measures the pore pressure.

On the other hand, if the contact surface of the BHA is in non-engagement with the wellbore wall (FIG. 3B), fluid in conduit 310 is isolated at one end by the closed sliding valve and at the other end by the filter 300. Should the pressure equalizing assembly be at rest in a position where conduit 310 is not in contact with the formation via filter 300, such as when drilling fluid, mud cake or other solids interfere with fluid flow into conduit 310, the fluid in conduit 310 will remain at the equalized pressure and the gauge will continue to read the annular pressure ($P_A$)

The downhole drilling tool may continue through various stops and starts and movement through the wellbore. As the tool stops and starts, the sliding valve will react and selectively establish communication between the conduit 310 and the buffer chamber 450 (FIGS. 4A and 4B). Typically, the drilling tool begins with the sliding valve in the open position and moves to the close position when the tool comes to rest. While in the open position (FIG. 4A), the conduit 310 is typically equalized to the higher annular pressure ($P_A$). When the tool comes to rest (FIG. 4B) and conduit 310 establishes fluid communication with the formation, the pressure in conduit 310 must lower to pore pressure ($P_P$). When the tool begins movement again, the sliding valve resets to the open position and annular pressure is re-established in conduit 310. The various changes in pressure may be monitored and compared with pressures throughout the drilling process and/or as measured by other downhole devices about the BHA. This information may be used to analyze the drilling process and determine various characteristics of the wellbore, formation, drilling tool and/or drilling process, among others.

Figure 5:
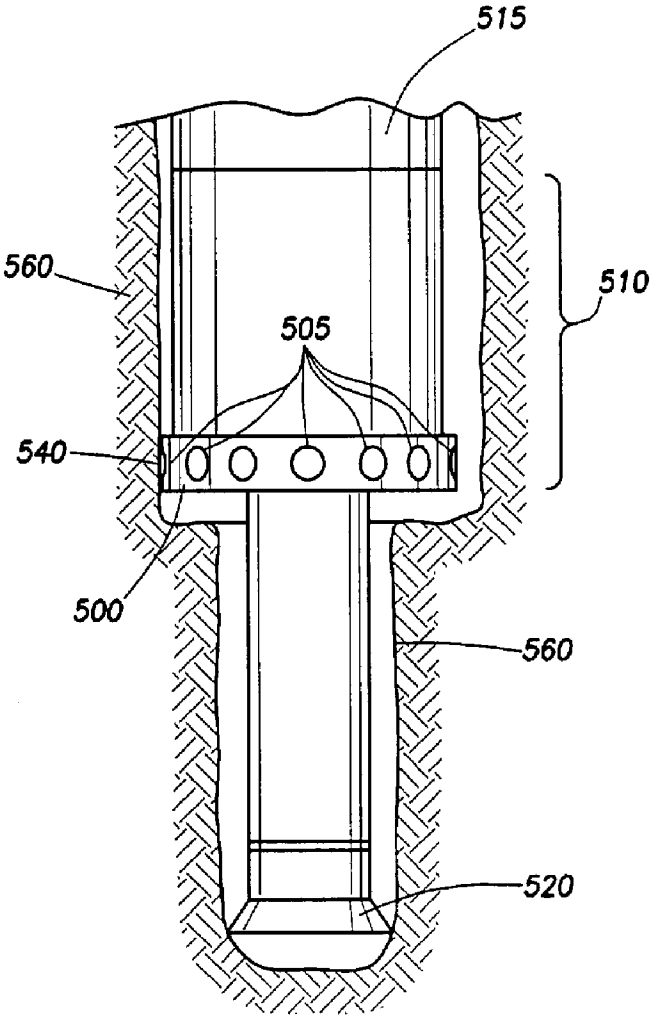
FIG. 5 is an elevational view, partially in cross-section, of an alternate embodiment of the BHA of FIG. 2 including an under reamer.

FIG. 5 shows an alternate embodiment of the BHA 510 of FIG. 2, and is connected to drill string 515 and drill bit 520. The BHA 510 includes an under reamer 500 and pressure equalizing assemblies 505. The BHA 510 is depicted in FIG. 5 has having a contact surface 540 along reamer 500 in contact with the wellbore 560. In this embodiment, the BHA does not include stabilizers, although stabilizers may optionally be incorporated.

As depicted in FIG. 5, the BHA may be provided with a variety of devices that extend from the drill collar and are capable of providing contact surfaces for pressure equalizing assemblies, such as stabilizers, wear rings, drill bits, under reamers, and other devices. Optionally, pressure equalizing assemblies may also be positioned along the drill collar itself. Additionally, the BHA may be located at various positions along the drill string.

Figure 6:
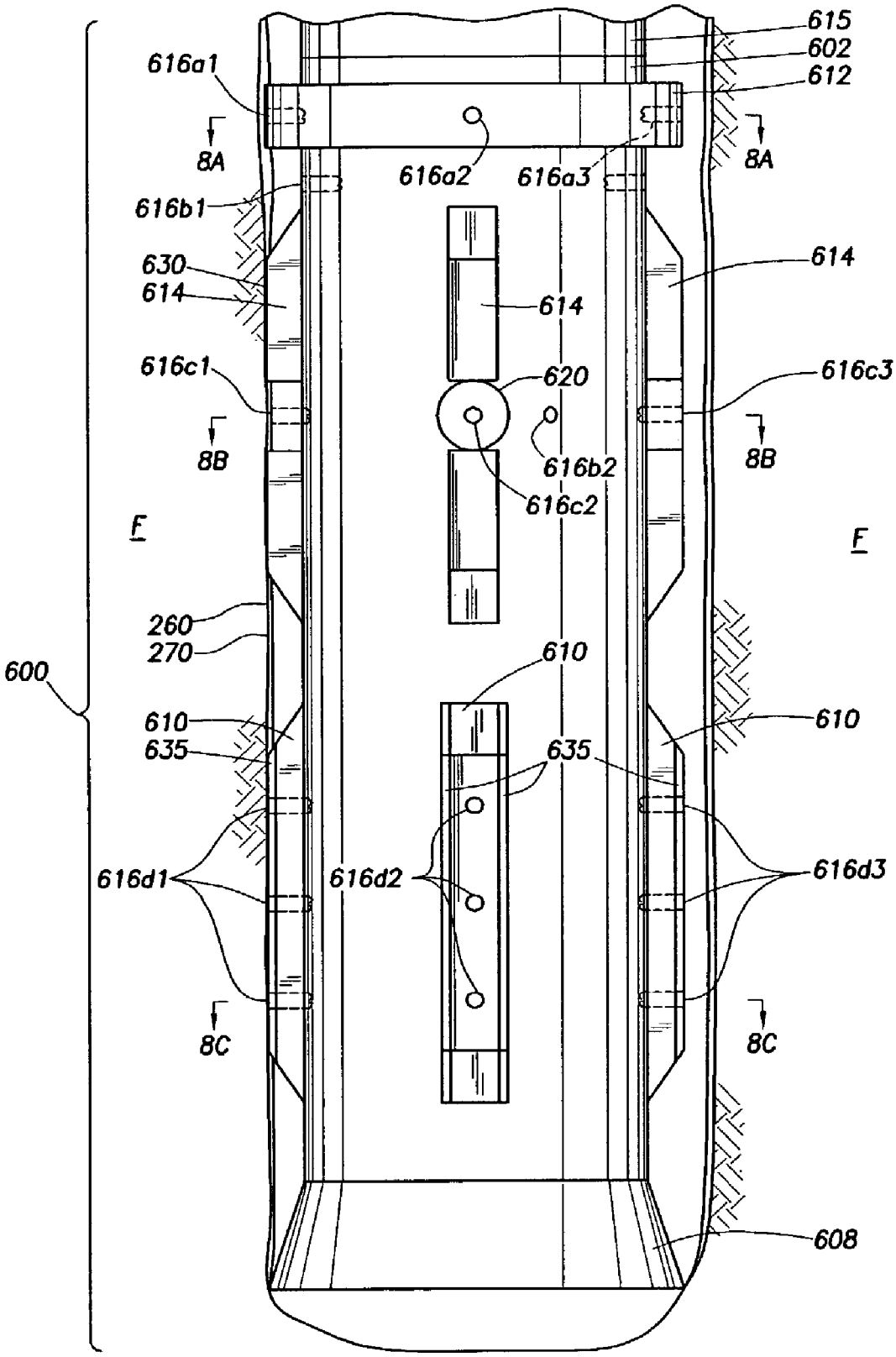
FIG. 6 is an elevational view, partially in cross-section, of a drilling system including drill collars having pressure measuring assemblies in accordance with the present invention.

Referring now to FIGS. 6–10 various embodiments of the present invention will now be described. FIG. 6 depicts a portion of a downhole drilling tool disposed in a wellbore, such as the downhole drilling tool of FIG. 1. The drilling tool as shown in FIG. 6 includes a drill string 615, a BHA 600, and a drill bit 608. The BHA 600 is operatively connected to drill string 615 in the same manner as previously described for BHA 200 of FIG. 2.

As shown in FIG. 6, the BHA 600 includes a drill collar 602 made of metal tubing, a wear band 612, stabilizer blades 614 and stabilizer blades 610. Preferably, wear band 612 is generally circular and extends radially about the drill collar. The stabilizer blades 614 and 610 are axially disposed at intervals about the drill collar 602, and extend radially therefrom. The wear bands, stabilizers and other such protrusions extend from the drill collar for contact with the wellbore. The drill collar is typically a non-protruding portion with reduced contact with the wellbore.

While FIG. 6 depicts a variety of devices or protrusions extending from the drill collar, a variety of such devices may be disposed about the drill collar 602 in a variety of arrangements, if desired. Other configurations of one or more such devices may be envisioned as previously discussed herein. For example, the downhole drilling tool 600 may include various protrusions, such as the linear and/or spiral stabilizer blades, wear bands, bits, reamers and/or other protrusions extending a distance radially beyond the drill collar 602.

The BHA 600 is also provided with a plurality of pressure measuring assemblies 616*a*, 616*b*, 616*c* and 616*d* positioned about the wear ring, stabilizers and drill collar. As shown in FIG. 6, multiple pressure measuring assemblies are depicted at various positions about the BHA. However, it will be appreciated that one or more pressure measuring assemblies may be positioned on multiple protruding and/or non-protruding portions of one or more drill collars and/or BHAs. Additionally, the pressure measuring assemblies may be arranged in geometric or random patterns to facilitate the opportunity for achieving multiple sequential and/or simultaneous measurements during the drilling operation.

As shown in FIG. 6, portions of the BHA are in contact with wellbore wall 260 and/or mudcake 270. For example, pressure measuring assemblies 616*a*1, *c*1 and *d*1 each contact the wellbore wall 260 and/or mudcake 270. Portions of the BHA 600 positioned about these pressure measuring assemblies, such as wear ring 612 and stabilizer blades 614 and 610, are also in contact with the wellbore wall and/or mudcake. These portions of the BHA 600 may contact mudcake 270 lining the wellbore wall 260, or scrape away the mudcake and allow direct contact with the wellbore wall. Stabilizer blades 633 are provided with scrapers 635 with hardened and/or sharpened edges adapted to scrape mud from the wellbore wall. Portions of the BHA containing pressure measuring assemblies 616*a*2–4, *b*1–2, *c*2–4 and *d*2–4 do not contact the wellbore wall or mudcake.

Figure 7C:
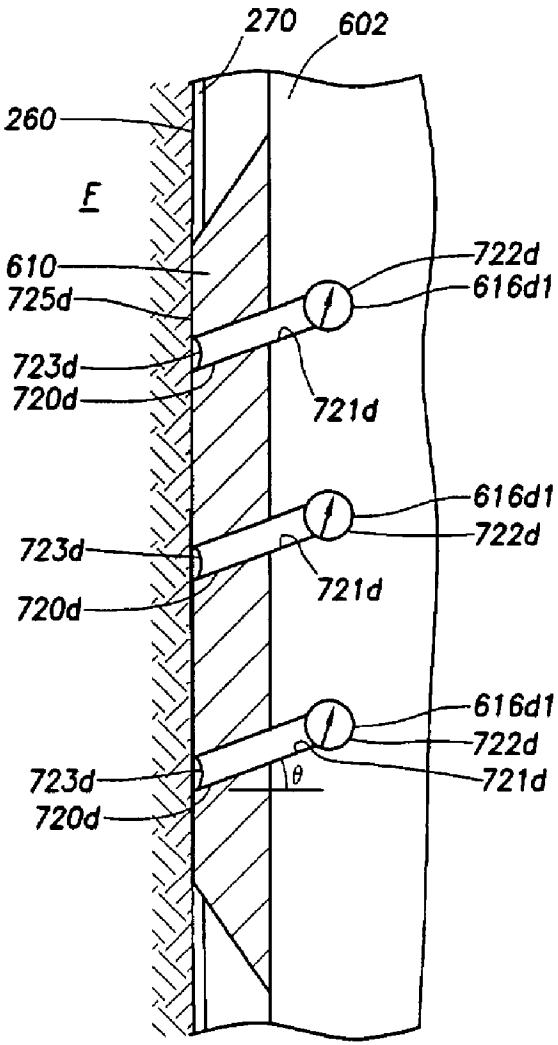
FIGS. 7A and 7B and 7C are partial, longitudinal cross-sectional views of the drilling system of FIG. 6 showing the pressure measuring assemblies in greater detail.
Figure 7B:
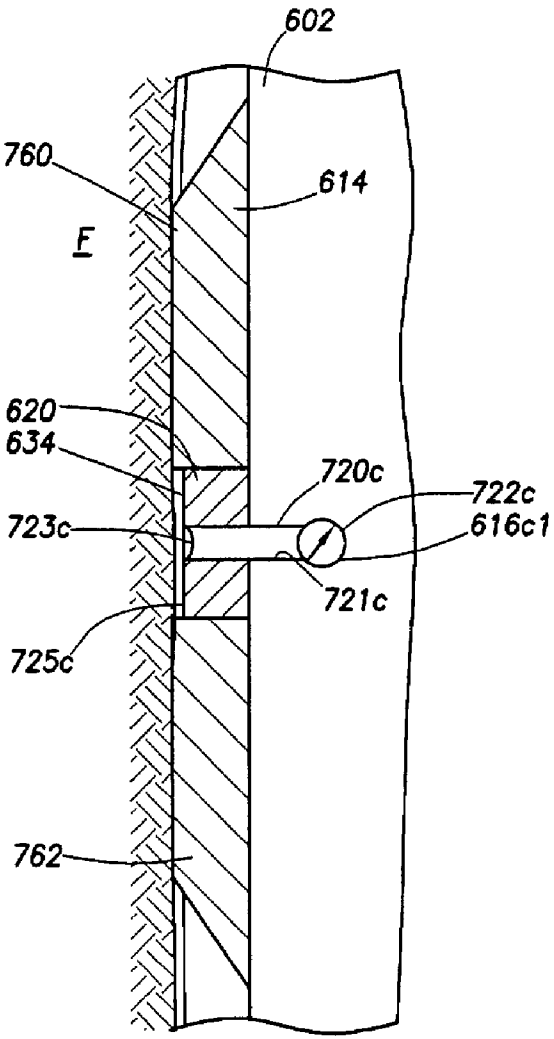
Figure 7A:
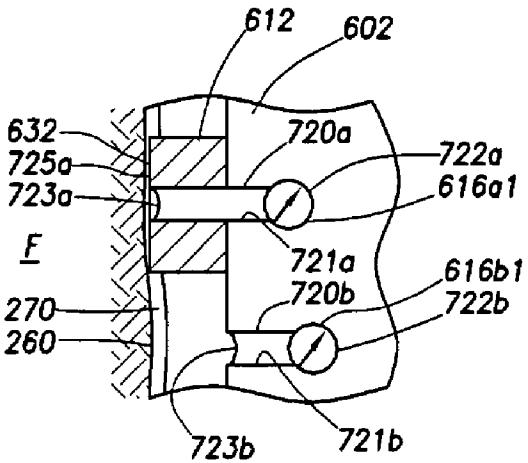
Figure 8C:
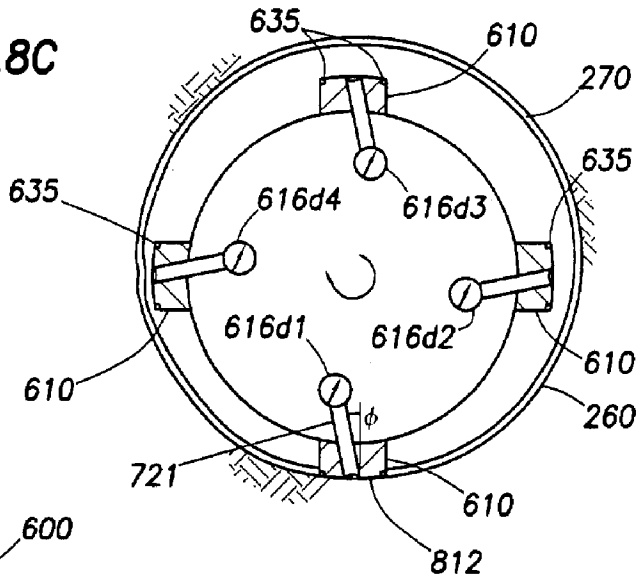
FIGS. 8A and 8B and 8C are partial, horizontal cross-sectional views of the drilling system of FIG. 6 taken along lines 8A—8A and 8B—8B and 8C—8C, respectively, depicting an alternate view of the pressure measuring assemblies.
Figure 8B:
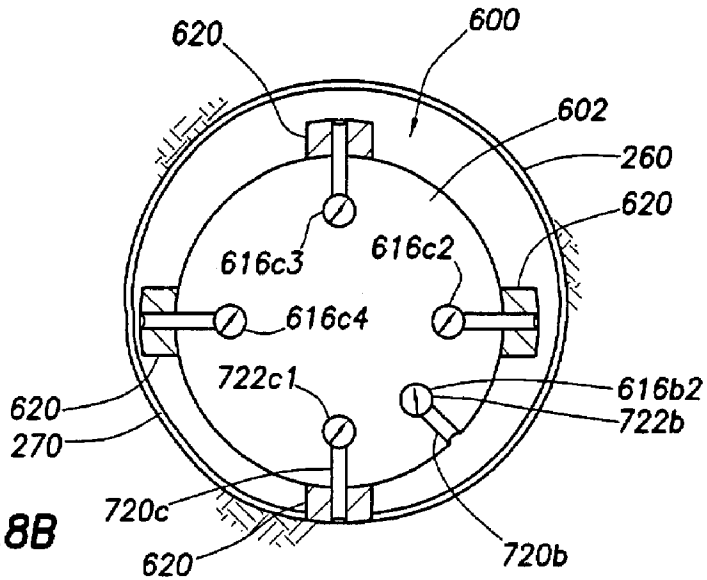
Figure 8A:
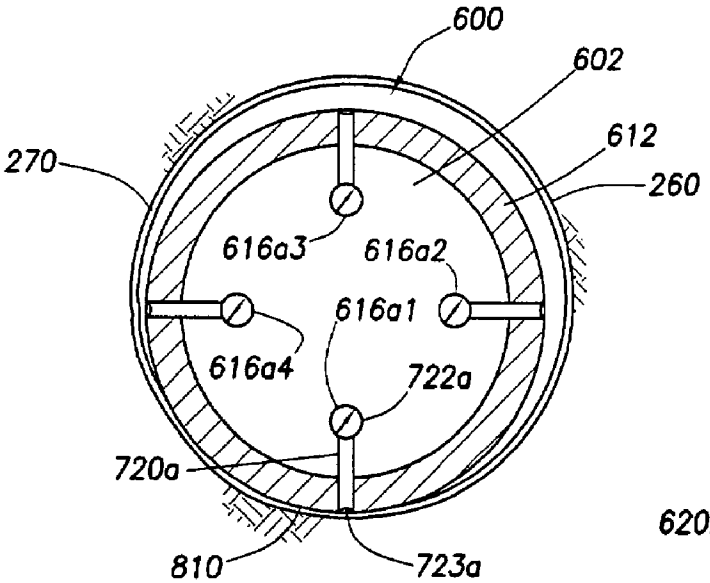

Referring now to FIGS. 7A and 8A, pressure measuring assemblies 616*a* of BHA 600 of FIG. 6 is depicted in greater detail. FIG. 7A is a longitudinal cross-sectional view of the pressure measuring assembly 616*a*1 of BHA 600. The wear ring 612 is shown as being in engagement with the wellbore wall 260 and mudcake 270. Preferably, the drill collar 602 is at rest with a protrusion, in this case wear band 612, resting against the wellbore wall 260. Drill collar 602 is in non-engagement with the wellbore wall 260.

Pressure measuring assembly 616*a*1 includes a conduit 720*a* defining a cavity 721*a* therein extending through wear band 612 and into the drill collar 602. An opening 723*a* of the cavity 721*a* extends through the outer surface 725*a* of wear band 612 and allows fluids to flow therein. A gauge 722*a* is operatively connected to conduit 720*a* for measuring fluid pressure therein. The gauge may be provided with associated measurement electronics as previously described with respect to the pressure gauge 340 of FIG. 3.

As shown in FIG. 7A, a portion of the wear band 612 is preferably positioned in sealing engagement with the wellbore wall 260 and mudcake 270. The mudcake 270 lining the wellbore preferably assists in providing sealing engagement between the protrusion 612 and the wellbore 260. Fluid communication is established between the conduit 720*a* and the formation F. In this position, fluid pressure in conduit 720*a* equalizes to the pressure of fluid in the surrounding formation. After fluid pressure is equalized, the gauge 722*a* measure the pressure of the formation, or the pore pressure $P_P$. Typically, the pressure in the conduit is higher than the formation, so fluid flows through the sidewall of the wellbore (and mudcake, if present) and percolates into the formation until pressure between the conduit and formation are equalized.

Referring still to FIG. 7A, a pressure measuring assembly 616*b*1 is positioned in drill collar 602. In contrast to pressure measuring assembly 616*a*1, pressure measuring assembly 616*b*1 is positioned in non-engagement with the wellbore wall 260 or mudcake 270. This assembly 616*b*1 includes a conduit 720*b* defining a cavity 721*b*. The cavity has an opening 723*b* extending through an outer surface of the drill collar 602 for allowing fluids to flow therein. A gauge 722*b* is operatively connected to conduit 720*b* for measuring fluid pressure therein. In this position, fluid pressure in conduit 720*b* equalizes to the pressure of fluid in the wellbore. The gauge 722*b*, therefore, measures the pressure of the wellbore, or the annular pressure $P_A$.

FIG. 7A depicts pressure measuring assembly 616*a*1 in combination with pressure measuring assembly 616*b*1. Pressure measuring assembly 616*a*1 is in fluid communication with the formation, while Pressure measuring assembly 616*b*1 is in fluid communication with the wellbore. The drilling tool may be provided with one or more pressure measuring assemblies that may be used alone or in combination with other pressure measuring assemblies at various positions about the downhole tool. By combining pressure measuring assemblies in fluid communication with the formation with others in fluid communication with the wellbore, the pressure measurements taken by the respective gauges may be compared and analyzed. In this way, it may be determined when a pressure measuring assembly measures formation pressure or wellbore pressure. Additionally, the changing conditions of the wellbore may also be detected. Various processors and analytical devices may be used in conjunction herewith for the purpose of collecting, compiling, analyzing, and determining measured data from one or more of the pressure measuring assemblies alone or in combination.

To facilitate such comparisons, multiple pressure measuring assemblies may be positioned at various locations along the downhole tool. A first set of assemblies may also be used to facilitate fluid communication with the formation, while another set of assemblies may be used to maintain fluid communication with the wellbore. To further assure the capture of a formation pressure measurement, assemblies may be positioned along various protrusions of the downhole tool. Similarly, to further assure wellbore pressure measurements, assemblies may be positioned along various portions of the downhole drilling tool that are least likely to contact the wellbore, such as drill collars or other non-protruding portions of the BHA 600. The conduit and related openings may also be positioned to facilitate such measurements. The pressure measuring assemblies may also be positioned at various depths along the tool such that measurements by various assemblies may be compared as the tool moves in the downhole tool and each assembly reaches a given depth.

FIG. 8A is a horizontal cross-sectional view of the BHA 600 of FIG. 6 taken along line 8A—8A and depicting the pressure measuring assemblies 616*a*1–*a*4 in greater detail. This provides an alternate view of the wellbore pressure measuring assembly 616*a*1 of FIG. 7A. This view of BHA 600 shows a portion of the wear band 612 resting against the wellbore wall 260 and mudcake 270. FIG. 8A depicts the conduits 720*a* of the pressure measuring assemblies 616*a* as linear and extend radially within the downhole tool and having a gauge 722*a* operatively connected thereto.

Wear ring 612 of drill collar 602 preferably has an outer surface 810 adapted to conform to the shape of the sidewall of the wellbore. Because the shape of the wellbore formed during the drilling process is circular, the outer surface of the wear band is preferably convex to conform to the wellbore wall. It is preferred that the outer surface of such a protrusion be adapted to sustain a seal with the wellbore wall for facilitating pressure measurements by one or more of the wellbore pressure measuring assemblies 616*a*.

Pressure measuring assemblies 616*a*1–*a*4 are positioned about the BHA 600. As shown in FIG. 8A, pressure measuring assemblies 616*a*2–4 do not have contact with wellbore wall 260. Pressure measuring assemblies 616*a*2–4 remain open to the wellbore and have fluid communication with the fluids therein. Thus, the pressure gauges for these pressure measuring assemblies will read the annular pressure $P_A$. The pressure measurements of each gauge may be compared for consistency.

In contrast, pressure measuring assembly 616*a*1 has contact with the wellbore wall 260 and may form a seal therewith. The pressure measuring assembly 616*a*1 is in fluid communication with the surrounding formation and equalizes therewith. The pressure gauge will, therefore read the pore pressure, $P_P$.

Should the wear ring 612 move into contact with the wellbore such that fluid communication is established between any of the pressure assemblies 616*a*2–4 and the formation, the pressure in assemblies at these positions will adjust from annular pressure $P_A$, to equalize with the formation pressure. When open to the wellbore, the pressure in the conduit is equalized to the annular pressure $P_A$, which is typically higher than the pore pressure $P_P$. Once fluid communication is established between the formation and the conduit, pressure equalization occurs between the conduit and the formation. The pressure gauge will then read the pore pressure $P_P$.

Similarly, should pressure measuring assembly 616*a*1 move out of contact with the wellbore such that fluid communication is no longer established with the formation, the pressure in assembly 616*a*1 will adjust from pore pressure $P_P$ to equalize with the wellbore pressure. When open to the wellbore, the pressure in the conduit is equalized to the wellbore pressure $P_A$ and the pressure gauge will then read the annular pressure $P_A$.

The amount of time necessary for pressure equalization to occur is mainly dependent on the hydraulic resistance of the residual filter cake, i.e. its thickness $\delta_o$ and permeability $k_f$ and the length of the sensor conduit, L. If the formation permeability is high enough, this time $t_e$ can be estimated as $$t_e \approx -\frac{L\delta_o}{3\eta_f}\log\left[\frac{PressureTolerance}{InitialOverbalance}\right] \quad (1)$$

where $\eta_f$ is determined from the following equation:

$$\eta_f = \frac{k_f B}{\Phi_f \mu}$$

(2) and where B is the bulk modulus of the mud cake, $\phi_f$ is its porosity and $\mu$ is the mud filtrate viscosity. Thus, the shorter the sensor conduit length, the quicker the pressure equalization. For example, where the mudcake thickness $\delta_o$=1 mm, the mudcake permeability $k_f$=$10^{-3}$ mD, the mudcake porosity $\phi_f$=0.2, the bulk modulus B=1 GPa, the length of the sensor conduit L=3 cm, and the relative tolerance 1%, the time of pressure equalization is estimated to be about 90 sec.

Referring now to FIGS. 7B and 8B, the stabilizer blade 614 and pressure measuring assemblies 616*c* of the BHA 600 of FIG. 6 are shown in greater detail. FIG. 7B is a longitudinal cross-sectional view of the pressure measuring assembly 616*c*1 of BHA 600. In this embodiment, pressure measuring assembly 616*c*1 includes a contact pad 620, a conduit 720*c* and a pressure gauge 722*c*. Conduit 720*c* defines a cavity 721*c* extending through the pad 620. The cavity 721*c* has an opening 723*c* extending through the outer surface 725*c* of the pad 620.

The pad 620 is positioned between a first portion 760 and a second portion 762 of a protrusion, in this case a vertical stabilizer blade 614. Preferably, the portions 760, 762 of the stabilizer blade 614 extend further from the drill collar 602 than the pad 620. However, in some cases, it may be desirable to have the pad flush with the protrusion or extending beyond the protrusion as depicted by the pressure assembly 616*c*3 of FIG. 6. As shown in FIG. 6, the pad 620 is depicted as being circular. However, other geometries are envisioned.

Referring back to FIG. 7B, the stabilizer blade 614 may be in direct contact with the wellbore wall 260. During drilling operations, various portions of the drilling tool, such as the stabilizer blade, may scrape away portions of the drilling mud 260 lining the wellbore wall. Various amounts of mud may be present between the blade, pad and/or drill collar during measurement. In this case, mud has been scraped away from the wellbore wall so that the stabilizer blade is in direct contact with the wellbore wall. However, mud remains between pad 620 and the wellbore wall 260. In this position, a seal is affected between the pad and the wellbore wall such that fluid communication is established between the conduit 720*c* and the formation. Fluid pressure equalizes between the cavity 721*c* and the formation. The gauge, therefore, measures the pressure of the formation, or the pore pressure $P_P$.

Referring now to FIG. 8B, a horizontal cross-sectional view of the BHA 600 of FIG. 6 taken along line 8B—8B depicting the pressure measuring assemblies 616*c* in greater detail is provided. This also provides an alternate view of the pressure measuring assembly 616*c*1 of FIG. 7B. The BHA 600 includes four pressure measuring assemblies 616*c*1–*c*4 and a pressure measuring assembly 616*b*2 positioned about the downhole tool. The stabilizer blade containing pressure measuring assembly 616*c*1 is in engagement with the wellbore wall. The stabilizer blades containing pressure measuring assemblies 616*c*2–4 are in non-engagement with the wellbore wall.

Pressure measuring assemblies 616*c*2–4 are open to the wellbore and have fluid communication with the fluids therein. Thus, the pressure gauges for these pressure measuring assemblies will read the annular pressure $P_A$ as previously described with respect to pressure measuring assembly 616*a*2–4 of FIG. 8B. In contrast, pad 620 of pressure measuring assembly 616*c*1 has contact with the wellbore wall 260 (and in this case the mudcake 270) and may form a seal therewith. The pressure measuring assembly 616*c*1 is in fluid communication with the surrounding formation and equalize therewith as previously described with respect to pressure measuring assembly 616*a*1 of FIG. 8A. The pressure gauge will, therefore, read the pore pressure $P_P$.

An additional pressure measuring assembly 616*b*2 is also depicted in FIG. 8B. Pressure measuring assembly 616*b*2 includes a conduit 720*b* and a gauge 722*b*. Conduit 720*b* extends radially inward into the drill collar 602. Pressure measuring assembly 616*b*2 is positioned on a non-protruding portion of the BHA and in non-engagement with the wellbore. In this position, fluid pressure in conduit 720*b* equalizes to the pressure of fluid in the wellbore. The gauge 722*b*, therefore, measures the pressure of the wellbore, or the annular pressure $P_A$ as previously described with respect to pressure measuring assembly 616*b*of FIG. 8A.

Referring now to FIGS. 7C and 8C, pressure measuring assemblies 616*d* of BHA 600 of FIG. 6 is depicted in greater detail. FIG. 7C is a longitudinal cross-sectional view of the pressure measuring assemblies 616*d*1 of BHA 600. The stabilizer blade 610 is shown as being in engagement with the wellbore wall 260. Preferably, the drill collar 602 is at rest with a protrusion, in this case stabilizer blade 610, resting against the wellbore wall 260.

The stabilizer blade 610 is provided with three pressure equalizing assemblies 616*d*1. Pressure measuring assemblies 616*d*1 includes a conduit 720*d* defining a cavity 721*d* therein extending through stabilizer blade 610 and into the drill collar 602. An opening 723*d* of the cavity 721*d* extends through the outer surface 725*d* of stabilizer blade 610 and allows fluids to flow therein. A gauge 722*d* is operatively connected to conduit 720*d* for measuring fluid pressure therein.

As shown in FIG. 7C, the stabilizer blade 610 is a linear stabilizer blade preferably positioned in sealing engagement with the wellbore wall 260. In this case, the mudcake 270 lining the wellbore has been scraped away by scraper 635 (FIG. 6), but may be positioned about the stabilizer to assists in providing sealing engagement between the protrusion 612 and the wellbore 260. Fluid communication is established between the conduits 720*d* and the formation F, and, fluid pressure in conduit 720*d* equalizes to the pressure of fluid in the surrounding formation as previously discussed with respect to pressure measuring assembly 616*a*1 of FIG. 8A. Because multiple pressure equalizing assemblies are contained in the stabilizer blade, there exists multiple opportunities to achieve a pressure measurement and/or to cross check readings.

The pressure measuring assemblies 616*d*1 each include a conduit 720*d* position at an upward angle θ relative to horizontal. The angle of the conduit is intended to, among others, allow gravity to facilitate the flow of heavier solids or fluids from the conduit, facilitate the trapping of lighter fluids, prevent clogging in the conduit, and reduce measurement and/or equalization time. While this downward angle may be preferred in some instances, it will be appreciated that any conduit herein may be provided with a configuration to facilitate the flow of fluid therein as desired. For example, the angle may be downward to assist in preventing the entry of mud into the conduit.

FIG. 8C is a horizontal cross-sectional view of the BHA 600 of FIG. 6 taken along line 8C—8C and depicting the pressure measuring assemblies 616*d*1–*d*4 in greater detail. This also provides an alternate view of the wellbore pressure measuring assemblies 616*d*1 of FIG. 7C. This view of BHA 600 shows the pressure measuring assemblies 616*d*1 resting against the wellbore wall 260, and pressure measuring assemblies 616*d*2–*d*4 in non-engagement with the wellbore wall.

Stabilizer blade 610 of drill collar 602 preferably has an outer surface 812 adapted to conform to the shape of the sidewall of the wellbore. Because the shape of the wellbore formed during the drilling process is circular, the outer surface of the stabilizer is preferably convex to conform to the wellbore wall. It is preferred that the outer surface of such a protrusion be adapted to sustain a seal with the wellbore wall for facilitating pressure measurements by one or more of the wellbore pressure measuring assemblies 616*d*. The linear edges of the stabilizer blades are provided with sharpened and/or hardened scrapers 635. The scrapers may be integrally formed, or removably attached to the stabilizer. This is an optional feature that may be used to scrape the wellbore wall to remove mud and/or facilitate sealing engagement with the wellbore wall.

Pressure measuring assemblies 616*d*1–*d*4 are positioned about the BHA 600. As shown in FIG. 8C, pressure measuring assemblies 616*d*2–4 do not have contact with wellbore wall 260. Pressure measuring assemblies 616*d*2–4 remain open to the wellbore and have fluid communication with the fluids therein. Thus, the pressure gauges for these pressure measuring assemblies will read the annular pressure $P_A$. The pressure measurements of each gauge may be compared for consistency.

In contrast, pressure measuring assembly 616*d*1 has contact with the wellbore wall 260 and may form a seal therewith. The pressure measuring assembly 616*d*1 is in fluid communication with the surrounding formation and equalizes therewith. The pressure gauge will, therefore read the pore pressure, $P_P$.

Each of the pressure measuring assemblies 616*d* have a conduit 720*d* extending through the stabilizer and into the drill collar at an angle ϕ. The angle of the conduit is intended to point in a direction opposite the rotation of the tool (indicated by the arrow) to prevent the tool from clogging as the protrusion scrapes against the tool and draws mudcake into the conduit. The conduit may be angled as desired, opposite the direction of rotation to prevent clogging and/or facilitate measurements, or not at all. In this case, the arrow indicates clockwise rotation. Thus, the angle of conduit 720*d* is at an angle ϕ pointing away from the direction of rotation.

As shown in FIG. 9A, the pressure measuring assemblies described herein may be provided with a pre-test piston 910*a* operatively connected to the conduit 720. The pretest piston 910*a* includes a cylinder 920*a* with a piston 930*a* slidably movable therein. The piston defines a fluid chamber 940*a* and a dead volume chamber 950*a*. The piston 930*a* may be advanced as indicated by the arrow to reduce the dead volume chamber. Typically, the piston is driven by a motor, or the like, but may also be responsive to pressures. Advancement of the piston 930*a* to the bottom of the cylinder 920*a* causes the pressure in the cavity 742 to fall below the formation pressure. Fluid from the formation will, therefore, be drawn into the cavity 742. Using this configuration, a pretest may be performed using known methods, such as those previously described in U.S. Pat. Nos. 4,936,139 and 4,860,581 assigned to the assignee of the present invention.

FIG. 9B shows another embodiment of a pressure measuring assembly 616 using a pretest piston assembly 910*b*. This pretest incorporates a cylinder 910 radially positioned about the conduit 720. A filter 960 is provided to prevent the flow of solids into the cylinder. A piston 930*b* is positioned in conduit 720 and axially movable therein as indicated by the arrows to selectively permit the flow of fluid into conduit 720 and/or cylinder 910*b*. The piston 930*b* is driven by a motor 970 and wormgear 980. Optionally, a piston and cylinder arrangement, or other mechanism may be used to axially drive the piston 930 within the conduit 720.

In operation, the pressure measuring assembly 616 may be activated to perform a pretest by activating the motor 970 to turn the wormgear 980 and axially drive the psiton inward into the BHA 600. As the piston retracts further into the tool, fluid from outside the BHA 600 is permitted to enter conduit 720. As the piston 930*b* advances past at least a portion of the filter 960 and cylinder 910, fluid is permitted to enter the cylinder through the filter. The pressure gauge 722 will then respond to the change in fluid pressure and register accordingly. The amount of fluid permitted to enter the cylinder is determined by the position of the piston relative to the cylinder. The piston may be advanced to either partially or completely open the cylinder to external fluids. A pretest may then be performed by controlling the flow of fluid as desired.

As shown in FIG. 10, the pressure measuring assembly 616 may be provided with an actuator 109 for selectively extending the conduit 720 into engagement with the wellbore wall 260. The actuator may include pistons 110 extending from cylinders 120 and operatively connected to pad 620 for extension thereof. Thus, when formation pressure measuring assemblies 616 are in non-engagement with the wellbore wall and/or in non-fluid communication with the formation, the pressure measuring assemblies may be actuated to move the pressure measuring assembly and/or a corresponding protrusion into engagement with the wellbore wall. The conduit 720 of pressure measuring assembly 616 preferably includes a first portion 105 and a second portion 107 telescopically arranged to allow extension thereof upon extension via the actuator. Actuation may be effected using techniques, such as those described in U.S. Pat. No. 6,230,557 assigned to the assignee of the present invention.

The pressure assembles provided herein may optionally be connected to processors and other analytical tools for use uphole. For example, the pressure measuring assemblies may be mounted in a typical logging while drilling drill collar and linked to known electronics acquisition systems to house and record data. By using multiple assemblies in combination, it is possible to cross-check and/or analyze multiple readings taken simultaneously or sequentially. Because sensors may be distributed about the downhole tool, measurements at various depths may be re-confirmed by sensors at the same depths, or by sensors at other depths as they approach the same location. Such multiple measurements may be used for validation, or for determinations of changes in wellbore conditions.

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be easily adapted and used to perform specific formation sampling or testing operations without departing from the spirit of the invention. Accordingly, the scope of the invention should be limited only by the attached claims.

What is claimed is:

1. An apparatus for measuring downhole pressure, the apparatus disposed in a downhole drilling tool positionable in a wellbore having an annular pressure therein, the wellbore penetrating a subterranean formation having a pore pressure therein, the apparatus comprising:

a drill collar having at least one opening extending through an outer surface thereof and defining a cavity therein, the cavity receiving downhole fluids without actuation, the drill collar positionable adjacent a sidewall of the wellbore such that the cavity is in fluid communication with one of the wellbore and the formation whereby fluid flows therethrough and pressure is equalized therebetween; and a gauge for measuring pressure in the cavity.

2. The apparatus of claim 1 wherein the drill collar is connectable to the downhole drilling tool.

3. The apparatus of claim 1 wherein the cavity is positioned along the downhole tool at one of adjacent the bit, a distance from the bit and combinations thereof.

4. The apparatus of claim 1, further comprising a pad positioned about the at least one opening.

5. The apparatus of claim 4 wherein the pad is circular.

6. The apparatus of claim 4 wherein the pad is positioned within one of a stabilizer blade, under reamer and a wear ring.

7. The apparatus of claim 4 wherein the pad extends from the drilling tool for engagement with the wellbore wall.

8. The apparatus of claim 4 wherein the drilling tool includes one of a stabilizer blade, under reamer, wear ring and combinations thereof, and wherein the one of the stabilizer blade, under reamer and wear ring extends further from the downhole drilling tool than the pad.

9. The apparatus of claim 4, wherein the pad has an outer surface adapted to conform to the sidewall of the wellbore.

10. The apparatus of claim 9 wherein the pad is positionable in sealing engagement with the sidewall of the wellbore.

11. The apparatus of claim 1, wherein the drill collar has a protrusion extending therefrom, the protrusion defining a contact surface positionable adjacent the sidewall of the wellbore, the at least one opening extending through the contact surface.

12. The apparatus of claim 11 wherein the protrusion forms at least a portion of one of a stabilizer blade, under reamer and a wear ring.

13. The apparatus of claim 11 wherein the protrusion forms at least a portion of a bottom hole assembly connected to the downhole drilling tool.

14. The apparatus of claim 11 wherein the protrusion is extends from the drilling tool for engagement with the wellbore wall.

15. The apparatus of claim 1 further comprising a plurality of cavities and corresponding gauges.

16. The apparatus of claim 15 wherein at least one of the plurality of cavities is positionable in fluid communication with the wellbore and wherein the corresponding gauge measures the annular pressure.

17. The apparatus of claim 15 wherein at least one of the plurality of cavities is positionable in fluid communication with the formation whereby pressure is equalized therebetween and wherein the gauge measures the pore pressure.

18. The apparatus of claim 17 wherein at least one of the plurality of cavities is positionable in fluid communication with the wellbore and wherein the corresponding gauge measures the annular pressure.

19. A downhole drilling tool capable of measuring downhole pressures during a drilling operation, the downhole drilling tool positionable in a wellbore having an annular pressure therein, the wellbore penetrating a subterranean formation having a pore pressure therein, comprising:

a bit;

a drill string;

at least one drill collar connected to the drill string, the at least one drill collar having at least one opening through an outer surface thereof extending into a cavity therein to receive downhole fluids without actuation, the drill collar positionable within the wellbore such that the cavity is in fluid communication with one of the formation and the wellbore whereby pressure is equalized therebetween; and a gauge for measuring pressure of the fluid in the cavity whereby the one of the annular and the pore pressure is determined.

20. The apparatus of claim 19 wherein the drill collar is a bottom hole assembly connected to the downhole drilling tool.

21. The apparatus of claim 19 wherein the apparatus comprises a plurality of drill collars with corresponding cavities and gauges.

22. The apparatus of claim 19 wherein the drill collar is positionable along the downhole tool with the cavity at one of adjacent the bit, a distance from the bit and combinations thereof.

23. The apparatus of claim 19 wherein the drill collar is positioned in non-engagement with the wellbore wall such that the fluid in the cavity is in fluid communication with the wellbore whereby pressure is equalized therebetween and wherein the a gauge measures the annular pressure.

24. The apparatus of claim 19 wherein the drill collar is positioned in engagement with the wellbore wall such that the fluid in the cavity is in fluid communication with the formation whereby pressure is equalized therebetween and wherein the gauge measures the pore pressure.

25. The apparatus of claim 19, further comprising a pad positioned about the at least one opening of the cavity.

26. The apparatus of claim 25, wherein the pad has an outer surface adapted to conform to the sidewall of the wellbore.

27. The apparatus of claim 25 wherein the pad is positionable in sealing engagement with the sidewall of the wellbore.

28. The apparatus of claim 25 wherein the pad is circular.

29. The apparatus of claim 25 wherein the pad is positioned within one of a stabilizer blade, under reamer and a wear ring.

30. The apparatus of claim 25 wherein the pad is extended from the drilling tool for engagement with the wellbore wall.

31. The apparatus of claim 25 wherein the drilling tool includes one of a stabilizer blade, under reamer, wear ring and combinations thereof, and wherein the one of the stabilizer blade, under reamer and wear ring extends further from the downhole drilling tool than the pad.

32. The apparatus of claim 19, wherein the drill collar has an outer surface adapted to conform to the sidewall of the wellbore.

33. The apparatus of claim 32 wherein at least a portion of the outer surface of the drill collar is positionable in sealing engagement with the sidewall of the wellbore.

34. The apparatus of claim 19, wherein the drill collar has a protrusion extending from the drilling tool, the protrusion defining a contact surface positionable adjacent the sidewall of the wellbore.

35. The apparatus of claim 34 wherein the protrusion forms at least a portion of one of a stabilizer blade, under reamer and a wear ring.

36. The apparatus of claim 34 wherein the protrusion is one of a stabilizer blade, under reamer and a wear ring.

37. The apparatus of claim 36 wherein the protrusion is extended from the drill collar for engagement with the sidewall of the wellbore.

38. The apparatus of claim 19 wherein the drill collar has a plurality of cavities and corresponding gauges.

39. The apparatus of claim 38 wherein at least one of the plurality of cavities is in fluid communication with the wellbore.

40. A method of measuring downhole pressures during a drilling operation in a wellbore having an annular pressure therein, the wellbore penetrating a formation having a pore pressure therein, the method comprising:

positioning a downhole drilling tool in a wellbore, the downhole tool having a drill collar with at least one opening therethrough extending into a cavity therein, the cavity receiving downhole fluids without actuation, the gauge operatively connected to the cavity;

positioning the cavity in fluid communication with one of the formation and the wellbore such that pressure is equalized therebetween; and measuring the pressure in the cavity.

41. The method of claim 40 further comprising the step of positioning an outer surface of the downhole tool adjacent the sidewall of the wellbore, the at least one opening extending through the outer surface of the downhole tool.

42. The method of claim 41 wherein the step of positioning comprises positioning the outer surface in sealing engagement with the sidewall of the wellbore.

43. The method of claim 41 wherein the cavity is in fluid communication with the formation, and wherein the pressure measured is the pore pressure.

44. The method of claim 40 further comprising the step of positioning an outer surface of the downhole tool in non-engagement with the sidewall of the wellbore, the at least one opening extending through the outer surface of the downhole tool.

45. The method of claim 44 wherein the cavity is in fluid communication with the wellbore and the pressure measured is the annular pressure.

46. The method of claim 40 wherein the downhole tool comprises multiple cavities and corresponding gauges.

47. The method of claim 46 further comprising comparing the pressures in the cavities.

48. The method of claim 47 further comprising analyzing the pressures.

49. An apparatus for measuring downhole pressure, the apparatus comprising:

a first conduit in a protruding portion of the drilling tool, the conduit receiving downhole fluids without actuation, the protruding portion positionable adjacent a sidewall of the wellbore such that fluid communication is established between the first conduit and one of the formation and the wellbore and pressure equalization occurs therebetween;

a second conduit in a non-protruding portion of the drilling tool, the non-protruding portion positionable in non-engagement with the sidewall of the wellbore such that fluid communication is established between the second conduit and the wellbore and pressure equalization occurs therebetween; and at least one gauge for measuring the pressure in the conduits.

50. The apparatus of claim 49 wherein when the protruding portion is in non-engagement with the sidewall of the wellbore such that fluid communication is established between the first conduit and the wellbore whereby the at least one gauge reads annular pressure.

51. The apparatus of claim 50 wherein the non-protruding portion is in non-engagement with the sidewall of the wellbore such that fluid communication is established between the second conduit and the wellbore whereby the at least one gauge measures annular pressure.

52. The apparatus of claim 51 wherein when the outer surface of the drill collar is in non-engagement with the wellbore wall, fluid communication is established between the cavity and the wellbore and pressure equalization occurs therebetween whereby the annular pressure is determined.

53. The apparatus of claim 49 wherein the protruding portion is in engagement with the sidewall of the wellbore such that fluid communication is established between the first conduit and the formation whereby the at least one gauge measures pore pressure.

54. The apparatus of claim 53 wherein the non-protruding portion is in non-engagement with the sidewall of the wellbore such that fluid communication is established between the second conduit and the wellbore whereby at least one gauge measures annular pressure.

55. An apparatus for determining downhole pressures, the apparatus positionable in a downhole tool disposable in a wellbore, the apparatus comprising:

a drill collar having a cavity therein, the cavity receiving downhole fluid without actuation, the drill collar having an outer surface positionable in one of engagement and non-engagement with the wellbore wall, the cavity having an opening extending through the outer surface; and a gauge operatively connected to the cavity for measuring pressure therein.

56. The apparatus of claim 55 wherein when the outer surface of the drill collar is in engagement with the wellbore wall, fluid communication is established between the cavity and the formation and pressure equalization occurs therebetween whereby the pore pressure is determined.

* * * * *